US005575265A

United States Patent [19]

Kurihara et al.

[11] Patent Number: 5,575,265

[45] Date of Patent: Nov. 19, 1996

[54] DIAGNOSTIC METHOD FOR EVAPORATED FUEL GAS PURGING SYSTEM

[75] Inventors: Nobuo Kurihara, Hitachioota; Hiroshi Kimura; Yutaka Takaku, both of Hitachinaka; Toshio Ishii, Mito, all of Japan

[73] Assignee: Hitachi, Ltd., Japan

[21] Appl. No.: 507,562

[22] Filed: Jul. 26, 1995

[30] Foreign Application Priority Data

Jul. 26, 1994 [JP] Japan ..... 6-173837

[51] Int. Cl.[6] ..... F02M 33/02; F02D 41/22

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 5,193,512 | 3/1993 | Steinbrenner et al. | 123/520 |
| 5,317,909 | 6/1994 | Yamada et al. | 123/520 |
| 5,339,788 | 8/1994 | Blumenstock et al. | 123/520 |
| 5,347,971 | 9/1994 | Kobayashi et al. | 123/520 |
| 5,355,864 | 10/1994 | Kuroda et al. | 123/520 |
| 5,363,828 | 11/1994 | Yamashita et al. | 123/520 |
| 5,460,143 | 10/1995 | Narita | 123/520 |
| 5,463,998 | 11/1995 | Denz et al. | 123/520 |

FOREIGN PATENT DOCUMENTS

| | | |
|---|---|---|
| 5-272417 | 10/1993 | Japan . |
| 6-10779 | 1/1994 | Japan . |

*Primary Examiner*—Thomas N. Moulis

*Attorney, Agent, or Firm*—Evenson, McKeown, Edwards & Lenahan P.L.L.C.

[57] ABSTRACT

In an evaporated fuel gas purging system, an accurate diagnosis can be realized by providing a reference leakage apparatus (a gauge) having a preset amount of leakage, by intentionally causing a known leakage using the gauge means under the same condition of diagnosing a leakage, and by comparing the pressure change with the pressure change in using the reference leakage apparatus. In the process of diagnosing leakage by depressurizing or pressurizing and closing the inside of the evaporated fuel gas purging system so as to leave it under presence of pressure differences to the atmospheric pressure and then by detecting the pressure change, a difference occurs in the pressure changes inside the evaporated fuel gas purging system between when the gauge is opened and closed. Then sensitivity of the difference in the pressure changes to the leakage is improved under the condition during diagnosis such as fuel temperature, atmospheric pressure, amount of remaining fuel, fuel properties and so on. The accuracy of leakage diagnosis of the evaporated fuel gas purging system can be improved by removing the effect of evaporation of the fuel inside the tank.

12 Claims, 7 Drawing Sheets

DIAGNOSTIC METHOD FOR EVAPORATED FUEL GAS PURGING SYSTEM

BACKGROUND OF THE INVENTION AND SUMMARY

The present invention relates to an evaporated fuel gas purging system to prevent evaporated fuel gas produced in a fuel tank of a gasoline engine from purging to the atmosphere, and more particularly relates to a diagnostic method and a device for an evaporated fuel gas purging system suitable for accurately detecting leakage in the evaporated fuel gas purging system.

An evaporated fuel gas purging system is provided in a gasoline engine to prevent evaporated fuel gas produced in a fuel tank of a gasoline engine from purging to the atmosphere.

In this system, the evaporated fuel gas is temporarily absorbed to absorbent in a canister, and the absorbed evaporated fuel gas is purged into an intake pipe of the engine together with the fresh air sucked from an air port of the canister to be burned depending on the operating condition of the engine.

The evaporated fuel gas purging system sometimes becomes nonfunctional during driving of a vehicle due to various causes. When a hole or crack is formed or a pipe is uncoupled in the fuel tank or in the passage of the evaporated fuel gas between the fuel tank and the canister, it is natural that the evaporated fuel gas is not absorbed to the canister but purged to the atmosphere.

Further, since the evaporated fuel gas having been absorbed to the canister cannot be purged into the intake pipe of the engine, the evaporated fuel gas is gradually accumulated in the canister and purged to the atmosphere when the amount of the absorbed evaporated fuel gas exceeds the absorbable limit.

In order to prevent air pollution due to such a failure in the evaporated fuel gas purging system, there is proposed a device for detecting of and warning of a leakage of evaporated fuel gas to a driver during driving a vehicle.

A device for diagnosing a leakage in an evaporated fuel gas purging system is proposed, for example, in Japanese Patent Application Laid-Open No. 6-10779 (1994) where an open/close valve is provided to open or close an air port of a canister.

In this device, the inside of the evaporated fuel gas purging system including the fuel tank is brought to a negative pressure state by closing the open/close valve in the air port and opening a purge control valve and then closing the purge control valve. Leakage is detected from change of the pressure in the system under the closed state.

Another device is proposed, for example, in Japanese Patent Application Laid-Open No. 5-272417 (1993) where the inside of the evaporated fuel gas purging system is actively pressurized and a certain amount of air is injected in the system, and then the time interval in which the pressure reduces to a preset pressure is detected using a pressure switch.

However, in order to diagnose the leakage of the evaporated fuel gas purging system, pressure change due to leakage caused by the pressure difference to the atmospheric pressure is detected whichever method, depressurizing or pressurizing the closed system, is employed.

Therefore, if the pressure fluctuation occurs due to any other cause inside or outside the system, a mistake is made in the leakage diagnosis.

If evaporated fuel gas is generated inside the fuel tank, the pressure inside the evaporated fuel gas purging system increases. Since the pressure change generally occurs during the diagnosis and cannot be distinguished from the pressure change due to leakage, an error occurs in the diagnostic result.

Especially, under a circumstance in which fuel evaporation is accelerated, for example, after driving the vehicle at a high load for a long time or after leaving the vehicle in a hot place for long time when the amount of fuel remaining in the tank is small, the diagnosis becomes difficult since the pressure rise becomes extremely large by an increase in generation of evaporated fuel gas due to temperature rise of the fuel.

Further, the pressure change is different depending on the remaining amount of the fuel in the tank even if the leakage area is the same.

Furthermore, when fuel having a different volatility is supplied to the vehicle, an error occurs in the diagnosis since the generating rate of evaporated fuel gas is different even if the remaining amount of fuel is the same and consequently a difference occurs in the pressure rise.

Furthermore, the external circumstance of the evaporated fuel gas purging system, that is, a change in atmospheric pressure, also becomes a problem. A difference in the pressure change is caused between a low altitude and a high altitude exceeding 2000 m even if the leakage area is the same.

In the leakage diagnosis utilizing pressure change as described above, an error occurs in the diagnosis or a difficulty occurs in the diagnosis due to the pressure fluctuation factors inside and outside of the evaporated fuel gas purging system other than the leakage.

In the diagnosis of an evaporated fuel gas purging system, an object of the present invention is to achieve an accurate diagnosis by providing a reference leakage apparatus (a gauge) having a preset amount of leakage, by intentionally causing a known leakage using the gauge under the same condition of diagnosing a leakage, and by comparing the pressure change with the pressure change in using the reference leakage apparatus.

In the process of diagnosing leakage by depressurizing or pressurizing and closing the inside of the evaporated fuel gas purging system and leaving it under the presence of pressure differences to the atmospheric pressure and then by detecting the pressure change, a difference occurs in the pressure changes inside the evaporated fuel gas purging system between opening and closing of the gauge.

It is possible with the present invention to obtain improved sensitivity of the difference in the pressure changes to the leakage under the condition during diagnosis such as fuel temperature, atmospheric pressure, amount of remaining fuel, fuel properties and so on.

An object of the present invention is to improve the accuracy of leakage diagnosis of the evaporated fuel gas purging system by removing the effect due to evaporation of the fuel inside the tank.

Another object of the present invention is to provide a gauge so that in the case of the intentional leaking of evaporated fuel gas, the leaked evaporated fuel gas is not purged to the atmosphere, but leaked from the closed evaporated fuel gas purging system to an intake portion of an engine (for example, the portion between an air cleaner and a throttle valve) having a pressure near the atmospheric pressure.

In the case of performing the diagnosis by pressurizing, the evaporated fuel gas leaking through the gauge is sucked to the cylinders from the upstream of the throttle valve together with intake air. Therefore, the evaporated fuel gas is burned and consequently is not purged to the atmosphere.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
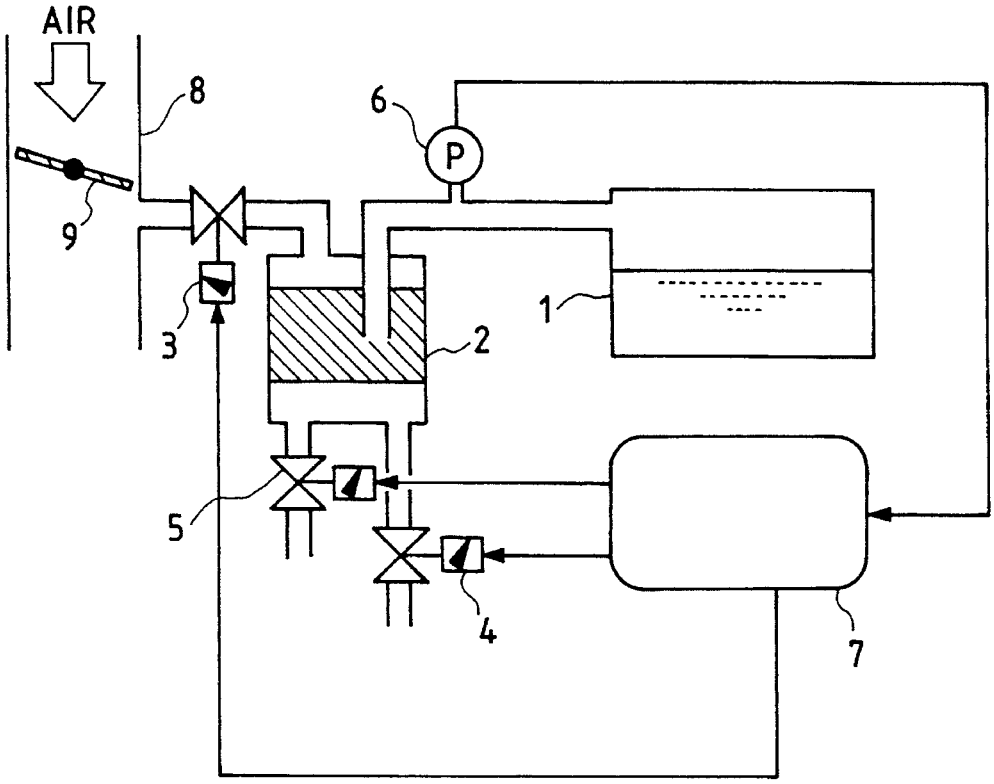
FIG. 1 is schematic view showing the structure of a first embodiment in accordance with the present invention.

FIG. 1 shows a fuel tank 1, a canister 2, a first control valve (or purging valve) 3, an intake pipe 8 and in an evaporated fuel gas purging system connecting these components with piping, a diagnostic device composed of a second control valve (or stop valve) 4, a third control valve (or gauge valve) 5, a pressure difference sensor 6 as a pressure sensor and a controller 7.

Figure 2:
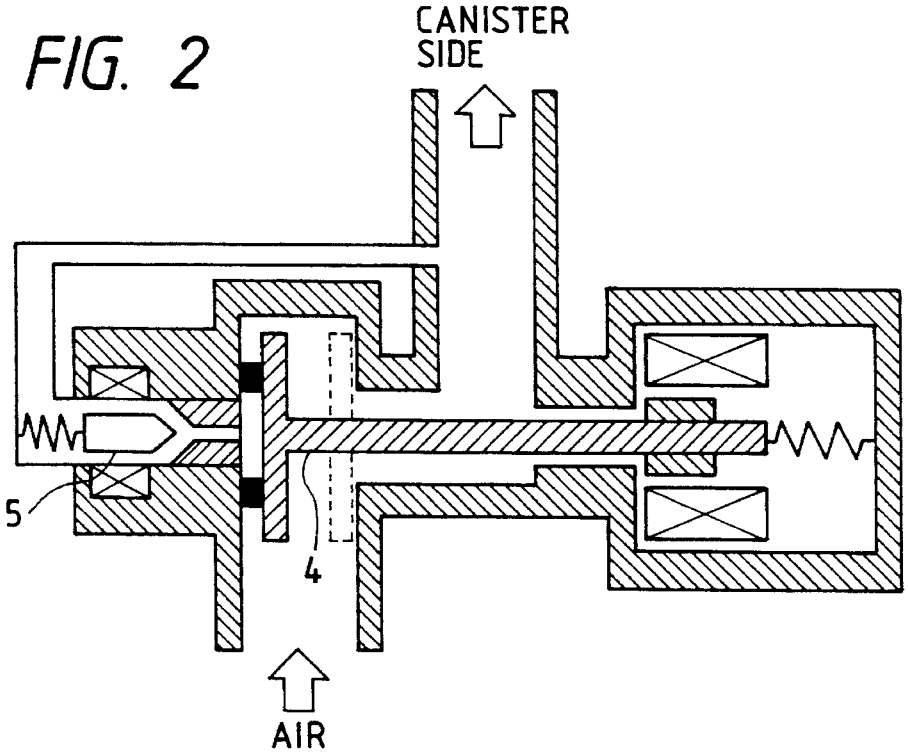
FIG. 2 is a view showing an embodiment in which a gauge valve and a stop valve are integrated in a unit.

FIG. 2 shows an embodiment in which the second control valve (stop valve) 4 and the third control valve (gauge valve) 5 are integrated in a unit. The third control valve (gauge valve) 5 has a gauge hole of predetermined size.

Figure 3:
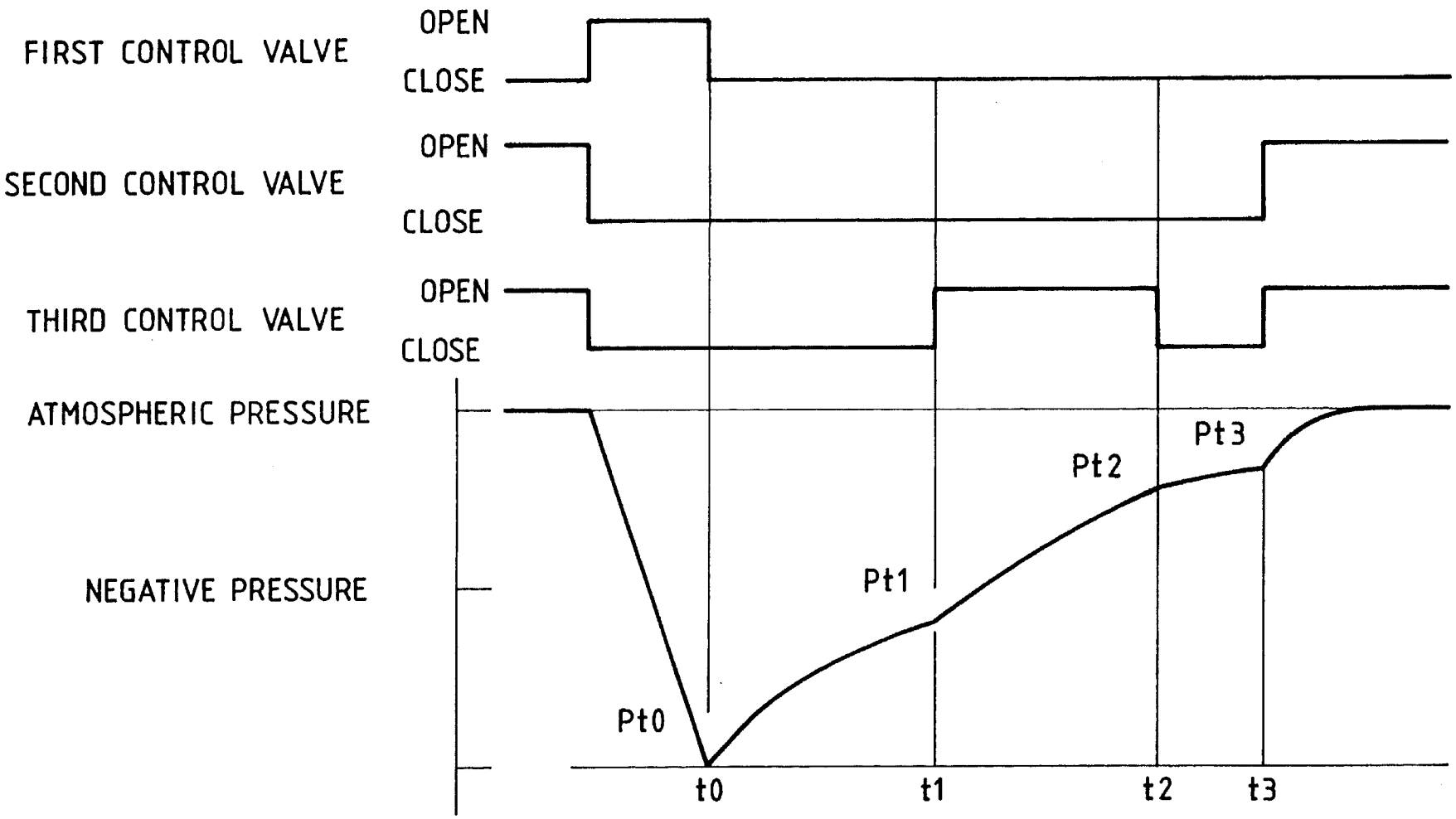
FIG. 3 is a timing chart showing the operations of various control valves used for diagnosis in the first embodiment.

The operation timings of the various control valves used for the diagnostic and the pressure variation inside the system of FIG. 1 will be described below, referring to FIG. 3.

In the normal condition, the first control valve (purge valve) 3 is closed and the second control valve (stop valve) 4 and the third control valve (gauge valve) 5 are kept open in order to prevent the fuel vapor generated in the fuel tank from purging to the atmosphere and to be absorbed to the canister 2.

When the first control valve (purge valve) 3 is opened according to the operating condition of the engine, the fuel vapor previously absorbed to the canister 2 is removed from the canister and is transferred to the intake pipe 8 together with the air flowing through the second control valve 4 opened to the atmosphere to be supplied for burning in the engine since the pressure inside the intake pipe 8 is negative.

When a leakage diagnosis is performed, initially the second control valve (stop valve) 4 and the third control valve (gauge valve) 5 are kept closed and the first control valve (purge valve)3 is opened.

The inside of the evaporated fuel gas purging system is rapidly depressurized since the pressure inside the intake pipe is negative.

The pressure inside the system is measured with the pressure difference sensor 6 of the pressure sensor and the first control valve 3 is closed depending on the pressure difference ($P_a$–$P_{t0}$) in relation to the atmospheric pressure $P_a$.

As the result, the system pressure is kept constant if there is no leakage since the system is closed.

If there is any leakage anywhere in the system, the pressure gradually approaches atmospheric pressure with a speed depending on the quantity of the leakage.

After a preset time ($t_1$–$t_0$) the pressure difference ($P_a$–$P_{t1}$) is measured, and then the third control valve (gauge valve) 5 is opened.

After a preset time ($t_2$–$t_1$) the pressure difference ($P_a$–$P_{t2}$) is measured. The above process is executed by the controller 7, and the leakage of the evaporated fuel gas purging system is judged based on the pressure differences ($P_a$–$P_{t1}$) and ($P_a$–$P_{t2}$).

Figure 4:
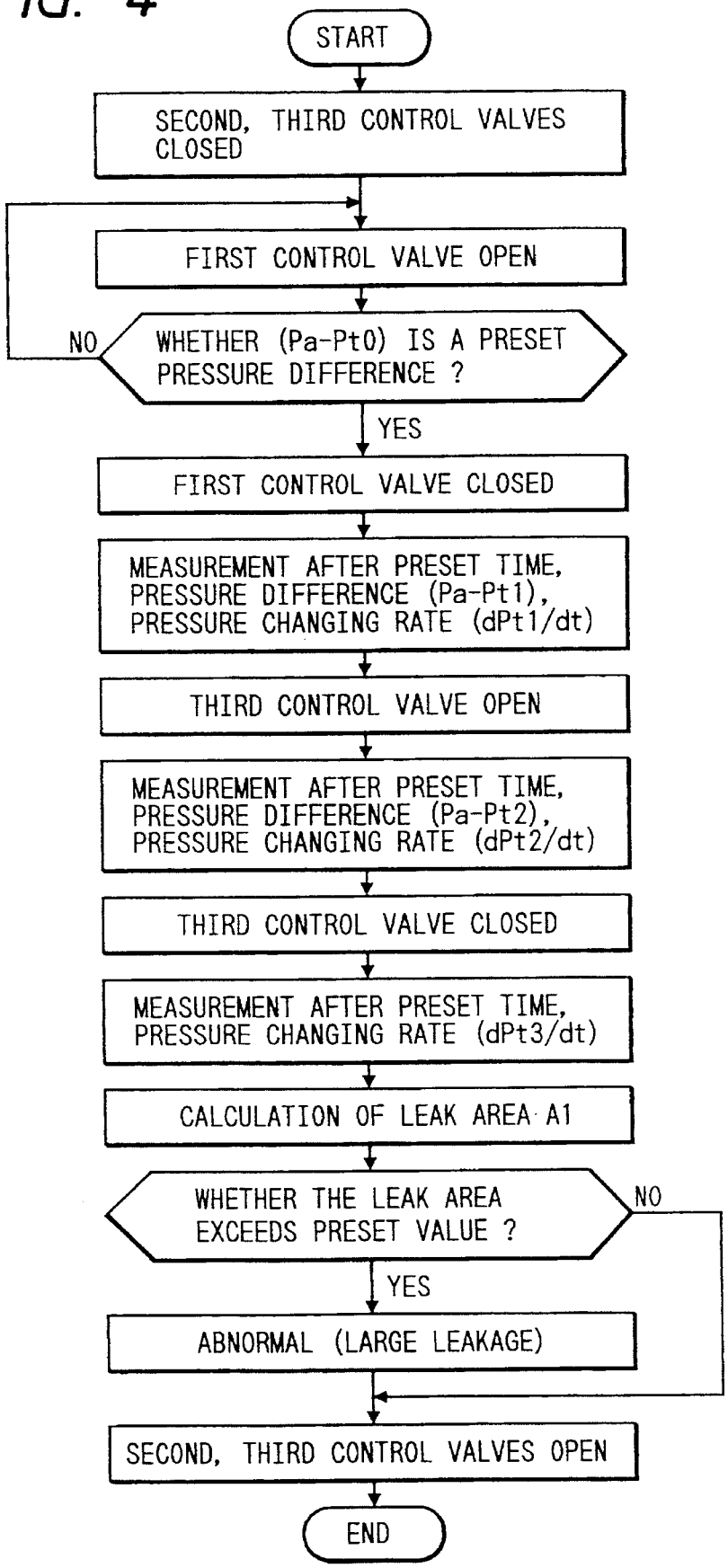
FIG. 4 is a flow chart of the diagnostic process in the first embodiment.

FIG. 4 is a flow chart showing the diagnostic process executed with the controller 7. The second and the third control valves 4, 5 are kept closed and the first control valve 3 is opened. The inside of the evaporated fuel gas purging system is rapidly depressurized since the evaporated gas is sucked to the intake pipe 8 with negative pressure.

When the pressure reaches a preset pressure difference ($P_a$–$P_{t0}$), the first control valve 3 is closed. The pressure gradually increases due to the leakage, and after leaving the system for a preset time, the pressure difference ($P_a$–$P_{t1}$) and the pressure changing rate $dP_{t1}/dt$ are measured. Then the second control valve (gauge valve) 4 is opened.

The pressure rise due to the leakage is accelerated, and after leaving the system for a preset time, the pressure difference ($P_a$–$P_{t2}$) and the pressure changing rate $dP_{t2}/dt$ are measured. Further again, the third control valve 5 is closed.

Since the system pressure has approached atmospheric pressure, the pressure rise due to the leakage is almost eliminated and the pressure rise due to evaporation of the fuel becomes dominant.

After leaving the system for a preset time, the pressure changing rate $dP_{t3}/dt$ is measured. Using the above measured results, a leakage are $A_1$ is calculated according to the following calculations.

The pressure P inside the closed evaporated fuel gas purging system can be basically expressed by Equation (1).

$$dP/dt=(RT/V)[A\sqrt{\{2\rho(P_a-P)\}}+(P_s-P_g)] \quad (1)$$

There, A: the leakage area, R: the gas constant, T: temperature of the gas, V: the volume of the evaporated fuel gas purging system, ρ: density of the gas, $P_a$: atmospheric pressure, $P_s$: saturated vapor pressure, $P_g$: partial pressure of the gas, k: evaporating rate.

Among these values, the volume of the evaporated fuel gas purging system V is a parameter which varies with the amount of fuel remaining in the tank, and the density of the gas ρ and the component of fuel evaporation pressure $k(P_s-P_g)$ are parameters which vary with the temperature of the fuel.

Using Equation (1), the leakage area $A_1$ can be obtained by inserting the above measured values of pressure differences ($P_a$–$P_{t1}$), ($P_a$–$P_{t2}$), ($P_a$–$P_{t3}$) and the pressure changing rates $dP_{t1}/dt$, $dP_{t2}/dt$, $dP_{t3}/dt$ into Equation (2). There, $A_g$ is the leakage area of the gauge valve 5.

$$A_1=A_g/[(dP_{t2}/dt-dP_{t3}/dt)/(dP_{t1}/dt-dP_{t3}/dt)\cdot\sqrt{\{(P_a-P_{t1})/(P_a-P_{t2})\}}-1] \quad (2)$$

If the leakage area $A_1$ exceeds a preset value, it is judged that the leakage area is abnormal and an alarm is output. Then, after completion of the diagnosis, the second and the third control valves 4, 5 are opened to return the pressure inside the evaporated fuel gas purging system to nearly atmospheric pressure.

In this embodiment, it is clear from comparing Equation (2) with Equation (1) that the volume of the evaporated fuel gas purging system V, the density of the gas ρ and the component of fuel evaporation pressure $k(P_s-P_g)$ in Equation (1) are eliminated in Equation (2), and accordingly the result of the diagnosis is not affected by the amount of fuel remaining in the tank or the temperature of the fuel.

Figure 5:
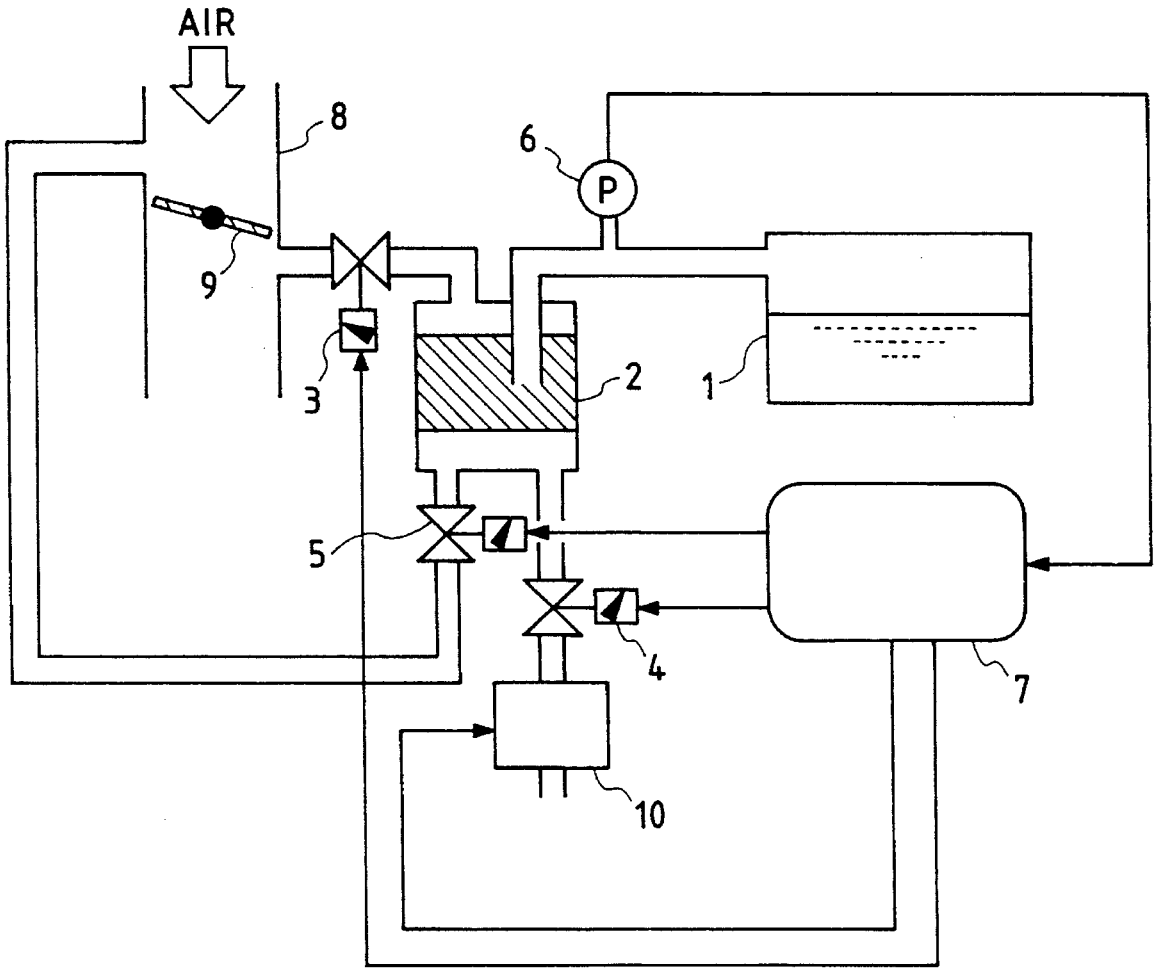
FIG. 5 is a schematic view showing the structure of a second embodiment in accordance with the present invention.

In the embodiment of FIG. 5, a diagnostic method of pressurizing the inside of the evaporated fuel gas purging system is employed.

This is a method performing diagnosis under a positive pressure state by pressurizing the inside of the evaporated fuel gas purging system. As a pressurizing device 10, a special purpose air pump may be used, or a secondary air pump installed in the exhausting part of the engine for promoting oxidation of hydrocarbon using a catalyst may be utilized.

In this pressurizing method, one side of the third control valve (gauge valve) 5 is jointed to the canister 2 and the other side is jointed upstream of the throttle 9 in the engine. That is, the gas leaked from the third control valve 5 is not purged to the atmosphere, but burned in the engine.

Figure 6:
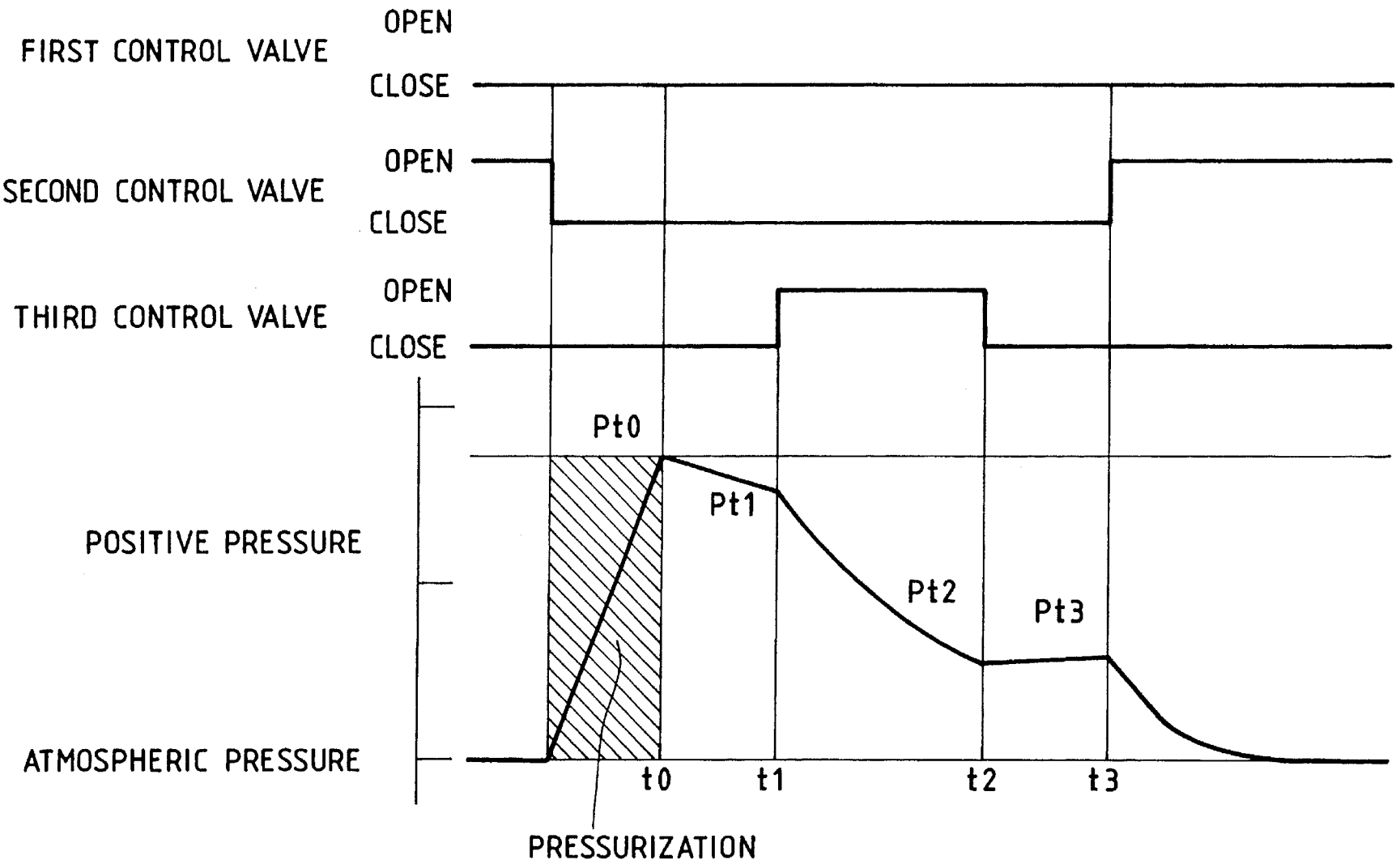
FIG. 6 is a timing chart showing the operations of various control valves used for diagnosis in the second embodiment.

FIG. 6 is a timing chart showing the operations of various control valves used for diagnosis in the second embodiment. Diagnosis is performed by always closing the third control valve.

Before performing the diagnosis, the second control valve 4 is kept open to be in an opening state to the atmosphere, and the third control valve 5 is kept closed.

Initially, the second control valve 4 is closed and the pressurizing device 10 is operated to pressurize the system up to a preset pressure difference $(P_{t0}-P_a)$ to the atmospheric pressure.

The operation of the pressurizing device 10 is stopped and the system is left as it is for a preset time $(t_1-t_0)$. The third control valve 5 is opened for a preset time $(t_2-t_1)$ to decrease the pressure by leaking the gas through the gauge hole.

Then, the third control valve 5 is closed, and the second control valve 4 is opened for $(t_3-t_2)$ and closed after then to return the system to the state before the diagnosis.

Figure 7:
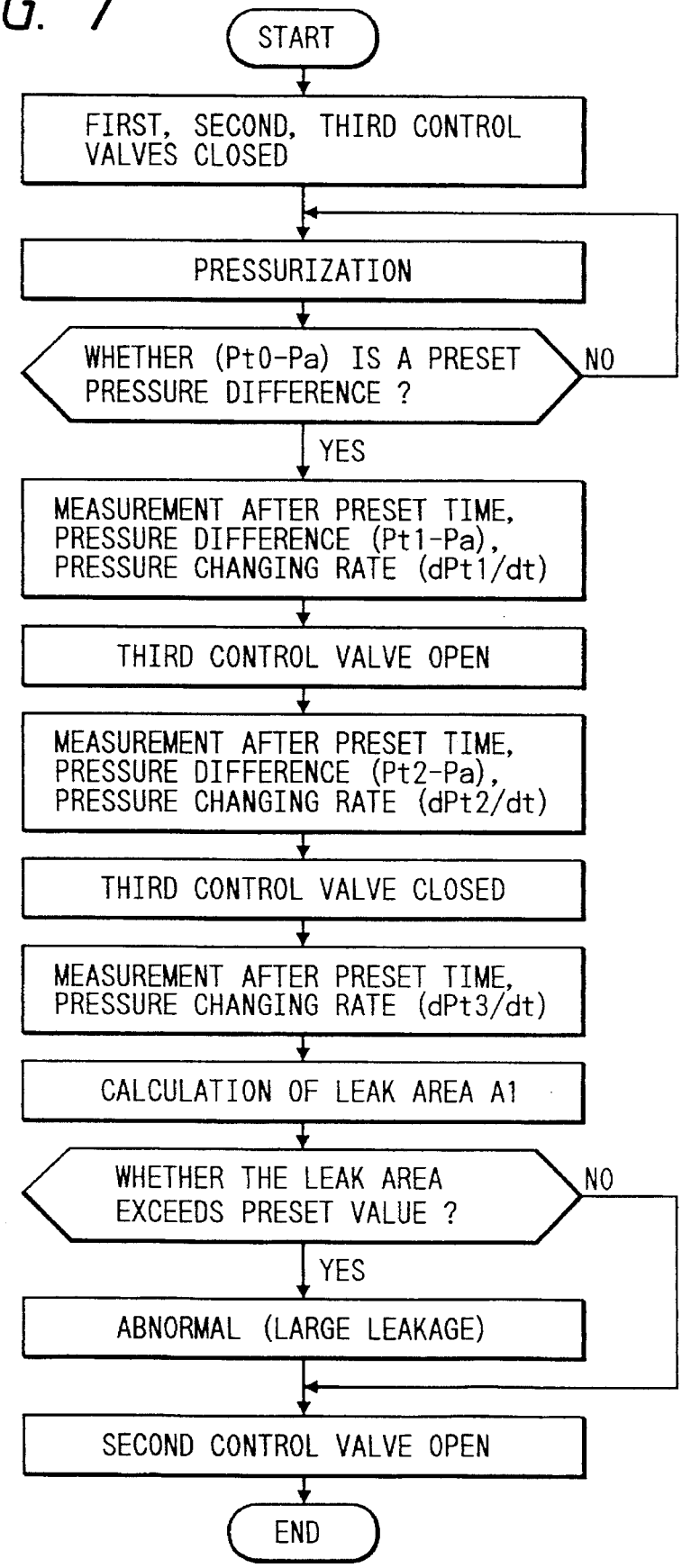
FIG. 7 is a flow chart of the diagnostic process in the second embodiment.

FIG. 7 is a flow chart of the diagnostic process executed in the controller 7 in the second embodiment. The first, the second and the third control valves are kept closed and the pressurizing device is started to be driven and continued to pressurize until the pressure reaches to a preset pressure difference $(P_{t0}-P_a)$.

When the pressure difference becomes $(P_{t0}-P_a)$, the system is held as it is to measure the pressure difference $(P_{t1}-P_a)$ and the pressure changing rate $dP_{t1}/dt$. Then the third control valve 5 is opened and the pressure difference $(P_{t2}-P_a)$ and the pressure changing rate $dP_{t2}/dt$ are measured.

The third control valve 5 is closed and the pressure changing rate $dP_{t1}/dt$ is measured after a preset time. Using the above measured data, the leakage area $A_1$ is obtained according to Equation (2).

If the area $A_1$ exceeds the preset value, it is judged that the leakage is large and an alarm is output. The diagnosis is completed by opening the second control valve.

Figure 8:
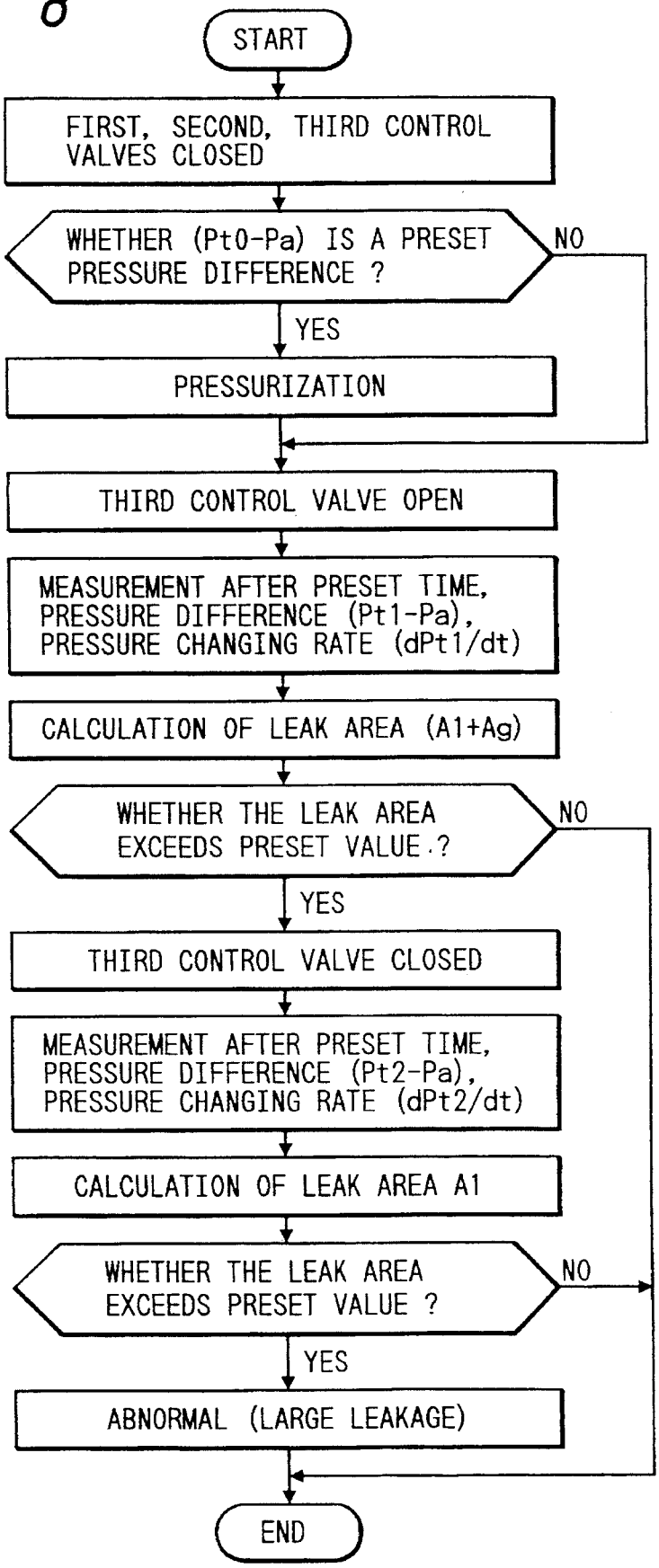
FIG. 8 is a flow chart of the diagnostic process in a third embodiment.

FIG. 8 is a flow chart of the diagnostic process for accelerating the diagnosis. As soon as the system is pressurized to a preset pressure difference $(P_{t0}-P_a)$, the third control valve is opened.

After a preset time, the pressure difference $(P_{t1}-P_a)$ and the pressure changing rate $dP_{t1}/dt$ are measured. The leakage areas $(A_1+A_g)$ are obtained according to Equation (1).

There, in Equation (1), pre-determined values are used for the gas constant R, temperature of the gas T, volume of the evaporated fuel gas purging system V and density of the gas ρ, and the fuel evaporating term $k(P_s-P_g)$ is neglected.

If the leakage areas $(A_1+A_g)$ are smaller than a preset value, it is judged that there is no leakage. If the leakage areas exceed the preset value, the third control valve is closed and after a preset time the pressure difference $(P_{t2}-P_a)$ and the pressure changing rate $dP_{t2}/dt$ are measured.

Using the above measured data, the leakage area $A_1$ is obtained according to Equation (2) with setting the pressure changing rate $dP_{t3}/dt=0$. If the area $A_1$ exceeds a preset value, it is judged that the leakage is large and an alarm is output. The diagnosis is completed by opening the second and the third control valves.

By performing the diagnosis while the third control valve is kept open, it is possible to diagnose in a short time even if the pressure change due to evaporation of the fuel is large.

The negative pressure method does not require any pressurizing device. On the other hand, in the pressurizing method, the diagnosis does not affect the combustion of the engine since the diagnosis can be performed while the first control valve is kept closed.

In both methods, the leakage area $A_1$ can be accurately detected by utilizing the third control valve.

Although the aforementioned embodiments employ the means to measure the pressure differences to the atmospheric pressure every preset time, it is possible to measure the pressure changing rates at preset pressure differences.

Further, instead of measuring the pressure changing rate in a small time interval, an average value in a certain time interval may be used.

Although the pressure changing rate is directly used in the aforementioned embodiments, it is possible to perform the diagnosis by using an equivalent quantity of pressure changing rate which is obtained, for example, by injecting a certain amount of air into the system to pressurize using a pressurizing device and measuring the time until the pressure decreases to the original pressure.

In the diagnosis according to the present invention, no difference appears in the diagnostic result depending on the operating condition of the engine since the sensitivity of the pressure change to leakage is checked at the time of diagnosis.

Therefore, in order to diagnose leakage of the evaporated fuel gas purging system, it is not necessary to additionally install a sensor for fuel temperature, a sensor for atmospheric pressure, a sensor for fuel remaining in tank and so on.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for diagnosing leakage in a system for recovering fuel vapor evaporated from a fuel tank for an internal combustion engine and having venting means for venting fuel vapor to atmosphere comprising the steps of detecting the leakage using means for closing the system, one of depressurizing and pressurizing inside the closed system, detecting one of pressure and pressure change inside the closed system and comparing an operational state with a non-operational state of the venting means.

2. A method according to claim 1, wherein the step of comparing includes obtaining one of pressure changing rates and equivalent quantities of pressure changing rates in the operational state of the venting means and in the non-operational state of the venting means; and calculating one of a difference and a ratio of the one of the pressure changing rates and the equivalent quantities of pressure changing rates.

3. A method according to claim 1, wherein one end of the venting means is connected to a part of the closed system constituted by a fuel vapor purging system and the other end of the venting means is connected to a part of the engine being at least near to atmospheric pressure.

4. A method according to claim 1, wherein, if an area of a leaking hole is judged to exceed a given value under the operational state of the venting means, the step of comparing includes estimating an area of the leaking hole under the non-operational state of the venting means.

5. A method according to claim 2, wherein the venting means includes an orifice and one of a solenoid stop valve and a solenoid stop valve having a given bore.

6. A method according to claim 2, wherein a closing means is integrated with the venting means.

7. A device for diagnosing leakage in a system for recovering fuel vapor evaporated from a fuel tank for an internal combustion engine by detecting the leakage comprising means for closing the system, means for one of depressurizing and pressurizing inside the closed system, means for detecting one of pressure and pressure change inside the system, and venting means for venting fuel vapor to atmosphere, such that leakage of the system is detected by comparing an operational state with an non-operational state of the venting means.

8. A device according to claim 7, wherein means is provided for obtaining one of pressure changing rates and equivalent quantities of pressure changing rates in the operational state and in the non-operational state of the venting means; and means for calculating one of a difference and a ratio of the pressure changing rates or the equivalent quantities of the pressure changing rates.

9. A device according to claim 7, wherein one end of the venting means is connected to a part of the closed system constituting a fuel vapor purging system and another end of the venting means is connected to an engine portion having a pressure at least near atmospheric pressure.

10. A device according to claim 7, wherein the venting means is configured to operate such that, if an area of a leaking hole is judged to exceed a given value under the operational state of the venting means, an estimate of the area of the leaking hole is again performed under the non-operational state of the venting means.

11. A device according to claim 8, wherein the venting means comprises an orifice and one of a solenoid stop valve and a solenoid stop valve having a predetermined bore.

12. A device according to claim 8, wherein the venting means and the closing means constitute an integrated unit.

* * * * *